US010772362B2

(12) United States Patent
Corley

(10) Patent No.: US 10,772,362 B2
(45) Date of Patent: Sep. 15, 2020

(54) BREAST SUPPORTING DEVICES AND METHODS

(71) Applicant: Tulifts, LLC, Tustin, CA (US)

(72) Inventor: Debra Corley, Dana Point, CA (US)

(73) Assignee: TULIFTS, LLC, Tustin, CA (US)

( * ) Notice: Subject to any disclaimer, the term of this patent is extended or adjusted under 35 U.S.C. 154(b) by 225 days.

(21) Appl. No.: 15/766,754

(22) PCT Filed: Oct. 12, 2016

(86) PCT No.: PCT/US2016/056557

§ 371 (c)(1),
(2) Date: Apr. 6, 2018

(87) PCT Pub. No.: WO2017/066260

PCT Pub. Date: Apr. 20, 2017

(65) Prior Publication Data

US 2018/0295893 A1 Oct. 18, 2018

Related U.S. Application Data

(60) Provisional application No. 62/339,285, filed on May 20, 2016, provisional application No. 62/240,397, filed on Oct. 12, 2015.

(51) Int. Cl.
*A41C 3/14* (2006.01)
*A41C 3/12* (2006.01)

(52) U.S. Cl.
CPC ..... *A41C 3/146* (2013.01); *A41C 3/128* (2013.01); *A41C 3/142* (2013.01); *A41C 3/144* (2013.01)

(58) Field of Classification Search
CPC ..... A41C 3/142; A41C 3/144; A41C 3/146; A41C 3/128
(Continued)

(56) References Cited

U.S. PATENT DOCUMENTS 2,604,325 A * 7/1952 Hansen ..... G11B 17/16 369/209
2,637,041 A * 5/1953 Bachmann ..... A41C 3/0007 2/260.1
(Continued)

FOREIGN PATENT DOCUMENTS

EP 2823721 A1 1/2015
JP 3037877 U 5/1997
(Continued)

OTHER PUBLICATIONS

KIPO, Int'l Search Report and Written Opinion, International Application No. PCT/US2016/056557, dated Jan. 11, 2017, 18 pages.

*Primary Examiner* — Gloria M Hale
(74) *Attorney, Agent, or Firm* — Umberg Zipser LLP

(57) ABSTRACT

The inventive subject matter provides breast supports that can advantageously be used with various types of bras to enhance the appearance and comfort provided. Contemplated breast supports include removable and insertable bra inserts, as well as breast supports that form a part of a bra. Breast supports can include padding and an internal support, each of which can be partially or completely enclosed in a cover material. The internal support can comprise a sheet of material including a multi-peaked upper edge, a rounded lower edge, and a mid-portion extending between the upper and lower edges.

20 Claims, 6 Drawing Sheets

(58) Field of Classification Search
USPC ..... 450/39, 41, 47, 49, 51, 54–57
See application file for complete search history.

(56) References Cited

U.S. PATENT DOCUMENTS

| | | | | | |
|---|---|---|---|---|---|
| 2,793,369 | A * | 5/1957 | Panighini | A41C 3/065 | 450/53 |
| 2,915,067 | A * | 12/1959 | Bracht | A41C 3/142 | 450/45 |
| 3,021,844 | A * | 2/1962 | Flagg | A41C 3/10 | 450/39 |
| 3,021,845 | A * | 2/1962 | Smith | A41C 3/10 | 450/39 |
| 3,163,167 | A * | 12/1964 | Chisholm | A41C 3/142 | 450/53 |
| 3,196,460 | A * | 7/1965 | Haistead | A41C 3/122 | 2/255 |
| 6,431,946 | B1 * | 8/2002 | Fildan | A41C 3/122 | 450/41 |
| 6,966,815 | B2 * | 11/2005 | Weinerth | A41C 3/10 | 450/39 |
| 7,163,433 | B2 * | 1/2007 | Chou | A41C 3/065 | 2/267 |
| 7,229,335 | B2 * | 6/2007 | Davis | A41C 3/065 | 450/54 |
| 2007/0087660 | A1 * | 4/2007 | Fildan | A41C 3/0007 | 450/41 |
| 2014/0213145 | A1 * | 7/2014 | McKeen | A41C 3/0021 | 450/59 |
| 2015/0087204 | A1 | 3/2015 | Conde | | |
| 2018/0352874 | A1 * | 12/2018 | Cahan | A41C 5/005 | |

FOREIGN PATENT DOCUMENTS

| | | | |
|---|---|---|---|
| JP | 2001-254205 | A | 9/2001 |
| JP | 2003-306803 | A | 10/2003 |

* cited by examiner

FIG. 9
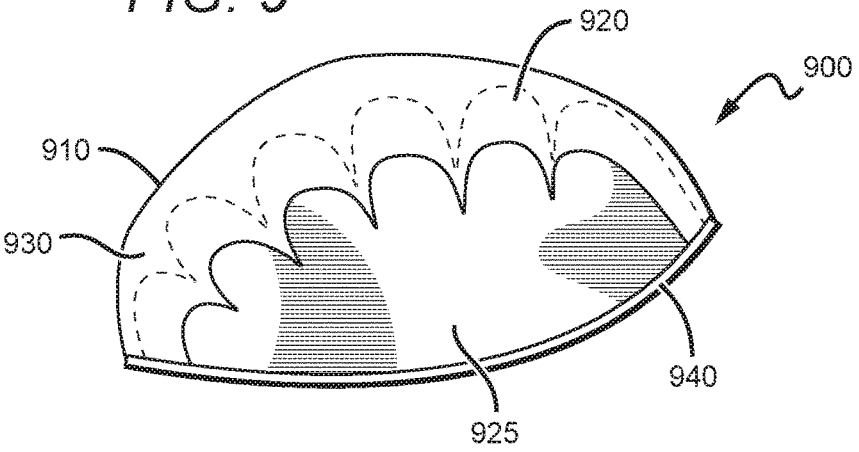
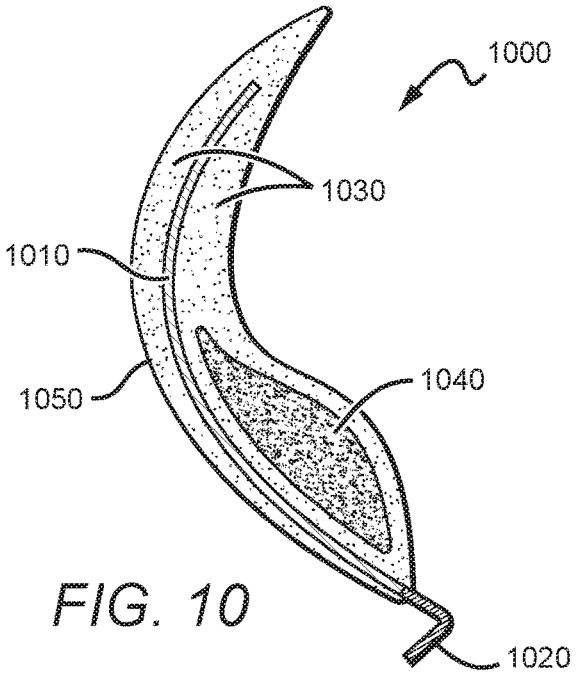
FIG. 10
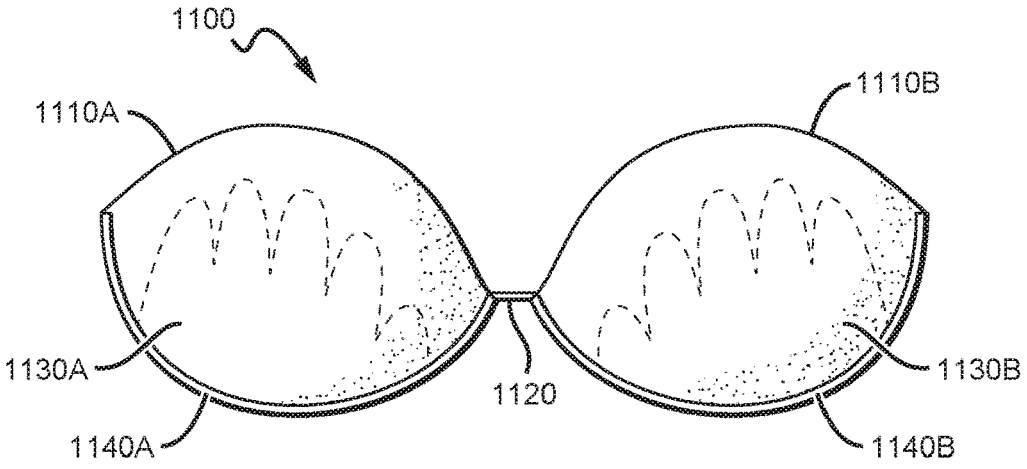
FIG. 11

BREAST SUPPORTING DEVICES AND METHODS

This application claims priority to U.S. provisional application having Ser. No. 62/240,397, filed Oct. 12, 2015, and U.S. provisional application having Ser. No. 62/339,285, filed May 20, 2016. These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

FIELD OF THE INVENTION

The field of the invention is breast supporting devices and methods.

BACKGROUND

The background description includes information that may be useful in understanding the present invention. It is not an admission that any of the information provided herein is prior art or relevant to the presently claimed invention, or that any publication specifically or implicitly referenced is prior art.

Women have been wearing modern style bras since at least the 1800s when the corset was cut into two separate undergarments. Bras have gone through quite the evolution in recent years with the introduction of cup sizes in the 1930s, torpedo style bras in the 1940s, pushup bras in the 1960s, and sports bras in the 1970s. While the styles may be ever-changing, there has been a constant desire for more enhancement, support and comfort.

For example, U.S. Pat. No. 6,447,365 to Powell et al. teaches a bra insert having an armature that is completely enclosed in an elastomeric surround, preferably having a portion that extends towards the underarm to prevent unwanted bulging and to provide comfort. Additionally, U.S. Pat. No. 8,747,184 to Liu teaches a support structure for placement in a lower periphery of a breast cup for a bra that includes polymer materials of different hardness. CN102085022A to Zhongrong teaches bras that include elastic ring-like bodies that can be used in place of typical metal under wires, and which can optionally include massage beads to provide a pulsating effect when the user moves.

Unfortunately, there seems to generally be an inverse relationship between comfort and support, with known bras failing to provide both in desired amounts. Additionally, many known cup structures are not removable, and are only intended for use with a single bra, making it difficult to achieve a consistent level of support and comfort with different types of bras.

Thus, there is still a need in the art for improved bras and breast supporting devices and methods.

SUMMARY OF THE INVENTION

The inventive subject matter provides bra inserts and bra pads that can advantageously be used to support and enhance the appearance of a wearer's breast with little or no discomfort when compared to existing bras with underwires or known inserts. Contemplated inserts can advantageous be used with various types of bras the wearer already owns, especially those that include pockets sized and dimensioned to receive the inserts. Viewed from a different perspective, a user can place the inserts of the inventive subject matter into a sports bra when exercising, remove them from the sports bra and place them in a t-shirt or lingerie bra when working, and then remove them from the lingerie bra and insert them into a bathing suit for swimming.

In some aspects of the inventive subject matter, a breast support (e.g., an insert or a pad of a bra) is provided including a padding (e.g., gel, silicone, polyester foam) and an internal support, each of which are completely or partially enclosed in a cover material. The cover material can enclose or otherwise couple with the internal components in any suitable way, including for example, an adhesive, sewing, or via a limited stitch construction utilizing chemical or mechanical bonds to adhere or secure the various components in place.

The internal support can comprise a solid sheet of rigid or semi-rigid material that includes an upper edge, a lower edge and a mid-portion extending between the upper and lower edges. The entire surface area of the internal support can comprise the rigid or semi-rigid material (e.g., can comprise a cutout from a sheet of the material), although small perforations can optionally be included in the internal support for enhanced breathability. In some aspects, the perforations can comprise less than 20%, more preferably less than 10% or less than 5% of the surface area of the internal support. The upper edge is preferably multi-peaked including at least one valley and at least two peaks.

The peaks of the internal support can be regular or irregular, rounded or angular, and can help allow the internal support to contour to the shape of the wearer's breast, even with changes in size or shape over time. For example, the internal support can include a scalloped edge with rounded peaks having widths that are between 50-300% of the heights of the peaks. In some other aspects, the multi-peaked edge can include rectangular, trapezoidal, triangular, or any other suitably shaped peaks. The multi-peaked upper edge can include valleys that have widths of between 1-150% of the heights of the valleys (e.g., between 1-50%, between 1-25%, between 1-10%), and the valleys can be rounded or angular. Rounded corners at the valleys can advantageously reduce stress concentrations, and help to prevent cracking and splitting when the internal support is used or washed.

The internal support could be made of any suitable material, including for example, a polypropylene having a crystallinity of between 50-60%, and a hardness of between 60-90 (on the Shore D hardness scale). Other contemplated materials include composite rigid plastic-fabric sheets, thermoformed plastic sheets, low or high density polyethylene, a metal, polyethylene terephthalate, polyvinyl chloride, rubber composites, acetal (polyoxymethylene), polystyrene, carbon fiber composites, fiberglass composites, Kevlar composites, and ABS (acrylonitrile-butadiene-styrene). The internal support can have any suitable hardness, including for example, a hardness of at least 10, at least 20, at least 30, at least 40, at least 50, at least 60, at least 70, at least 80, at least 100 on the Shore A hardness scale, a hardness of at least 10, at least 20, at least 30, at least 40, at least 50, at least 60, at least 70, at least 80, at least 100 on the Shore D hardness scale, or a hardness of at least 10, at least 20, at least 30, at least 40, at least 50, at least 60, at least 70, at least 80, at least 100 on the Shore 00 hardness scale. In some aspects, the internal support can comprise a single piece of material that is cut from a sheet (e.g., a polypropylene sheet having a uniform thickness or a tapered thickness). In other aspects, the internal support can comprise multiple pieces of materials that are coupled together.

Some contemplated breast supports can include an underwire that is partially or completely enclosed in the cover material. The underwire could be made of any suitable material (e.g., plastic, metal), and can be separated from the internal support by a small distance (e.g., between 1/16 and 1/2 an inch, between 1/16 and 1/4 inch). Additionally or alternatively, the underwire could be attached to the internal support at one or more points, for example via one or more rigid or semi-rigid connectors as further described below. Where included, preferred connection points for the connectors can include the bottom apex region of the underwire curve, and a mid-point of the lower edge of the internal support. Where there is a gap or gaps in between the internal support and the underwire, it is contemplated that the gap(s) could provide a stitch zone where the rigid components will not interfere.

In some other aspects, the internal support can be attached to the underwire along a lower edge of the internal support such that the lower edge is attached to an entire length of the underwire, more than 35% of the length of the underwire, more than 50% of the length of the underwire, more than 75% of the length of the underwire, more than 85% of the length of the underwire, or between 50-100% of the length of the underwire.

One or more of the underwire, the internal support and the connector(s) can be partially or fully encased/enclosed in a fabric surrounding of one or more pieces of material. The fabric surrounding can advantageously be textured, meshed or rubberized to provide an improved adhesion surface. Additionally or alternatively, one or more of the underwire, the internal support and the connector(s) can itself be made in part or in whole from a stiff or stiffened piece of material (e.g., fabric, plastic, rubber composite) that is textured.

In some contemplated aspects, the internal support, the underwire and the connector(s) are positioned within the thickness of the foam or other padding, and the textured nature of the fabric surrounding or the components can improve the mechanical or chemical bonding of the components to the padding where bonding is desired. The bonding of the internal components within the thickness of the padding, and the separation of the internal support and underwire from the edges of the breast support advantageously prevent the sharper edges or corners of some contemplated components from tearing through the breast support cover material, making the breast support even more durable.

Viewed from a different perspective, the inventive subject matter also provides multi-peaked internal supports that can be used in bra inserts or bra cups. As described above, some contemplated internal supports comprise a sheet of material including a rounded bottom edge and a multi-peaked upper edge. In some aspects, the entire outer perimeter of the internal support could be rounded (e.g., where the peaked portions are rounded). The internal supports can comprise an S-shaped cross section including an upper curvature and a lower curvature, a C-shaped cross section, a linear or substantially linear cross section (e.g., wherein the width of the cross section is less than 5 mm), a combination thereof, or any other suitable cross sectional shapes. Where the internal support has an S-shaped cross-section (i.e., a cross-section having at least two curvatures in generally opposite direction), the upper curvature preferably curves away from the wearer's breast, at least partially cupping the wearer's breast, and the lower curvature preferably curves towards the wearer's breast and is positioned under or on a bottom portion of the breast to provides structural support that lifts the wearer's breast.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWING

FIG. 9 illustrates internal components of another breast support.

FIG. 10 is a cross-sectional view of another breast support of the inventive subject matter having a push up pad and a c-shaped underwire.

FIG. 11 illustrates a breast support system including two breast supports coupled together via a bridge.

DETAILED DESCRIPTION

The following discussion provides example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

The inventive subject matter provides breast supports (e.g., an insert or a pad of a bra) including a foam padding and internal support, which are partially or completely enclosed in a cover material. The internal support can comprise a sheet of material including an upper edge, a lower edge and a mid-portion extending between the upper and lower edges. The upper edge is preferably multi-peaked including at least one rounded valley and at least two rounded peaks.

Figure 1A:
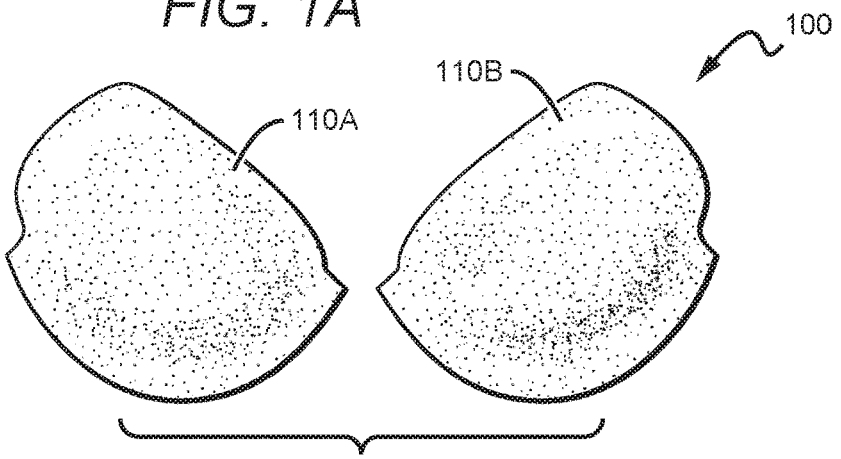
FIG. 1A is a front view of a pair of breast supports of the inventive subject matter.
Figure 1B:
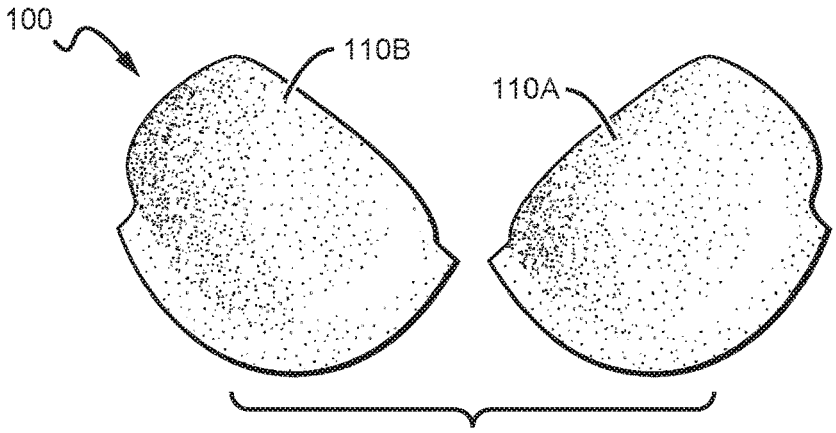
FIG. 1B is a rear view of the pair of breast supports of FIG. 1A.
Figure 1C:
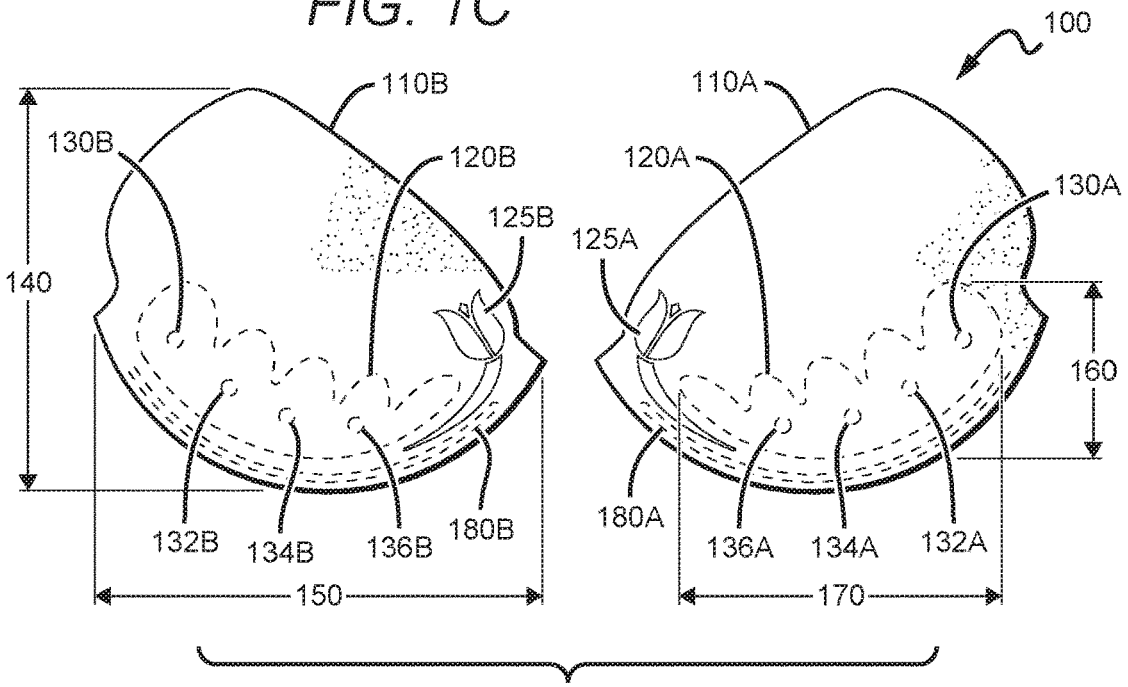
FIG. 1C is a rear view showing the internal components of the pair of breast supports of FIGS. 1A-1B.
Figure 1D:
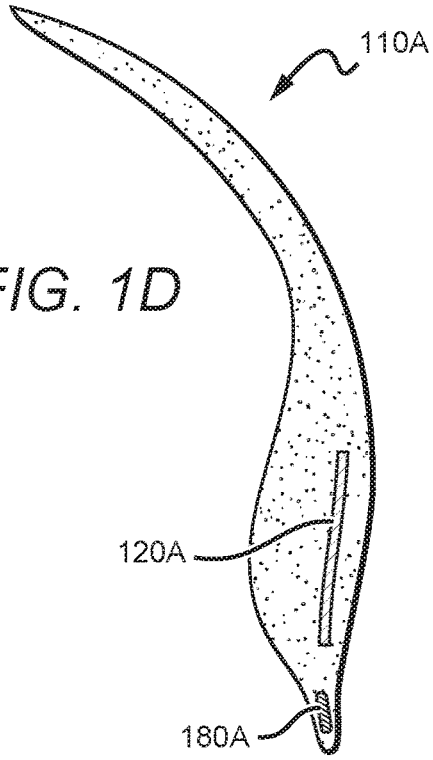
FIG. 1D is a cross-sectional view of breast support 110*a* of FIGS. 1A-1C.

FIGS. 1A-1D illustrate a pair of exemplary breast supports of the inventive subject matter, the pair 100 including a right bra insert 110*a* and a left bra insert 110*b*. FIG. 1A illustrates a front view, FIG. 1B illustrates a rear view, and FIG. 1C is a transparent rear view showing the internal components of the pair of breast supports 100. FIG. 1D is a cross-sectional view of right bra insert 110*a*.

As best shown in FIGS. 1C-1F, right bra insert 110*a* includes a logo 125*a* on the rear surface of the cover material to indicate that it is to be worn over the right breast. The internal components include a padding (e.g., a soft gel, polypropylene foam, foam having a density of between 10-60 kg/m$^3$, between 20-50 kg/m$^3$, or between 30-40 kg/m$^3$), a scalloped internal support 120*a*, and an underwire 180*a*. Internal support 120*a* is a solid piece of material that includes a plurality of perforations or openings 130*a*, 132*a*, 134*a*, and 136*a*, which advantageously add to the breathability of bra insert 110*a*, even through portions including the internal support (e.g., the lower portion). Preferably, the perforations are small relative to the surface area of the internal support such that the support provided by internal support 120*a* is not compromised.

Additionally, the perforations, along with the scalloped edge of the internal support 120*a*, can enhance the ability of the internal support to contour to the shape of the wearer's breast. Still further, the perforations can provide areas wherein the foam or other padding material surrounding the internal support can bond to itself, perhaps providing areas of stronger adhesion.

Left bra insert 110*b* is a mirror image of right bra insert 110*a*, and includes a logo 125*b* on the rear surface of the cover material (the surface facing the wearer when the insert is worn) to indicate it should be worn over the left breast. The internal components include a padding, a scalloped internal support 120*b* including a plurality of perforations or openings 130*b*, 132*b*, 134*b*, and 136*b*, and an underwire 180*b*. The cover material that encloses each of the internal components can comprise any suitable material(s), including for example, silk, lace, cotton, spandex, nylon, polyester, cotton, or any combinations thereof. In some contemplated embodiments, the cover material can be treated with antimicrobial agents to inhibit the growth of bacterial microbes.

The horizontal length 170 of the internal support 120*a* when the pair 100 of inserts are worn by a wearer can be less than, equal to or greater than the vertical height 160 of the internal support 120*a*. For example, the internal support 120*a* can have a length 170 that is at least 125%, at least 150%, or even 175% or more of its height 160. It should be appreciated that the horizontal length 170 of the internal support when worn can be shorter than the actual horizontal length of the internal support (e.g., when the longest length of the internal support is measured) where the internal support is raised on the outer-most end relative to the inner-most end (or vice versa). In some preferred embodiments, the highest point of an outer-most peak (e.g., peak above 130*a*) is at least 5 mm, more preferably at least 10 mm or even 15 mm or more above the highest point of an inner-most peak (e.g., peak next to logo 125*a*) when the insert is properly worn or oriented.

Additionally or alternatively, horizontal length 170 of internal support can be equal to, or less than a horizontal length 150 of the entire insert. For example, the horizontal length 170 can be at least 60%, at least 70%, at least 75%, at least 80%, less than 95%, less than 90%, less than 85%, less than 80%, or between 60-95% of the horizontal length 150 of the entire insert. Additionally or alternatively, the horizontal length 170 of the internal support can be less than 90%, less than 80%, less than 70%, less than 60%, less than 50%, less than 40%, less than 30%, between 10-40%, between 20-40%, between 30-40%, or between 10-30% of a height of the breast support.

In some preferred embodiments, the internal support 120*a* will be separated from an inner-most point (point of the insert that is closest to the cleavage of the wearer) of insert 110*a* by at least 2 mm, more preferably at least 5 mm, at least 10 mm, at least 20 mm, or at least 25 mm. The internal support 120*a* can be separated from an outer-most point (point of the insert that is closest to a left or right side of the wearer) of insert 110*a* by less 25 mm, more preferably less than 20 mm, and even more preferably less than 15 mm or even less than 10 mm. The separation between the internal support and the inner-most point can be less than or equal to the separation between the internal support and the outer-most point. However, it is generally preferred that the separation between the internal support and the inner-most point is greater than the separation between the internal support and the outer-most point (e.g., at least 50% greater (separation to inner-most point is 150% separation to outer-most point), at least 100% greater, at least 150% greater, at least 200% greater).

Figure 1E:
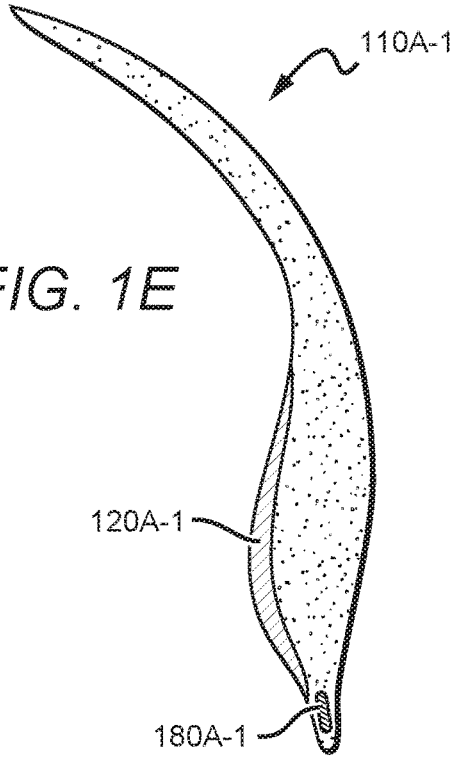
FIG. 1E is a cross-sectional view of another breast support 110*a*-1 having a C-shaped internal support.
Figure 1F:
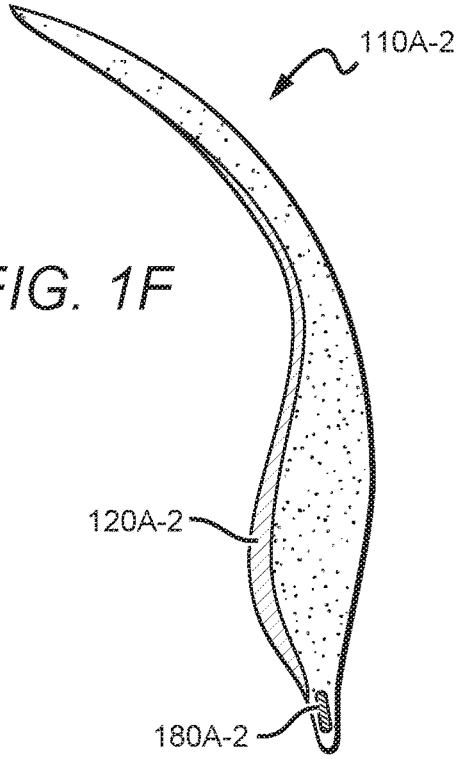
FIG. 1F is a cross-sectional view of another breast support 110*a*-2 having an S-shaped internal support.

As illustrated by the examples in FIGS. 1D-1F, an internal support can comprise any suitable shape when the insert is worn or not being worn. In FIG. 1D, right bra insert 110*a* comprises a substantially straight internal support 120*a* having a uniform thickness along its height (e.g., between 1-10 mm, between 1-5 mm, between 1-3 mm). In FIG. 1E, right bra insert 110*a*-1 is similar to insert 110*a*, but includes a flattened C-shaped internal support 120*a*-1 separated from underwire 180*a*-1. More specifically, internal support 120*a*-1 includes a cross-section having a single curvature and relatively flattened upper and lower ends. As there is no second curvature in a generally opposite direction, internal support 120*a*-1 is not an S-shaped internal support (or an internal support having an S-shaped cross-sectional portion). In FIG. 1F, insert 110*a*-2 includes an underwire 180*a*-2 and an S-shaped internal support 120*a*-2. The S-shaped cross-section will include two curvatures in generally opposite directions, and the two curvatures (e.g., upper and lower curvatures) can have the same or different sizes and curvature shapes. Depending on the mechanical properties of the material used, the S-shaped cross-section (and even some inserts having C-shaped cross-sections) can be springy, allowing each of the curvatures to partially collapse and expand. For example, the internal support can have a curvature with a spring-rate of between 5-20 lbs/inch, for example between 8-12 lbs/inch. Viewed from a different perspective, it is contemplated that the curvature of the cross-section can be flattened by between ⅛-¾ of an inch, for example between ¼-¾ of an inch. For example, where a curvature has a spring rate of 10 lb/inch, the curvature can be flattened by ½ inch where 5 lbs of weight is applied, or by ⅕ of an inch where 2 lbs of weight is applied. Depending on the mechanical properties of the material used, the geometry, and degree of curvature, the S-shaped-cross-section can perform like a spring as it deforms. Advantageously, the deformation will not be permanent, but rather elastic, so that the internal support will return to its original shape when not in use.

In some contemplated embodiments, an internal support can have an upper curvature (on the upper portion of the internal support) that curves away from the wearer when the breast support is worn, and a lower curvature (on the bottom portion of the internal support) that curves towards the wearer when the breast is worn. Alternatively, it is contemplated that the upper curvature can curve towards the wearer when the breast support is worn, and the lower curvature (on the bottom portion of the internal support) can curve away from the wearer when the breast is worn.

Internal supports having three or more curvatures alternating in opposite directions (e.g., away from the wearer—towards the wearer—away from the wearer; towards the wearer—away from the wearer—towards the wearer) are also contemplated, although generally not preferred unless there is sufficient padding in front of, and behind, the internal support.

Still further, some contemplated internal supports can have an inner portion (towards the sternum) and an outer portion (towards the underarm) having different cross-sectional shapes. For example, an internal support can have an inner portion having a cross-sectional shape that is S-shaped, and an outer portion having a cross-sectional shape that is C-shaped or substantially straight. Alternatively, an internal support can have an inner portion having a cross-sectional shape that is C-shaped or substantially straight, and an outer portion having a cross-sectional shape that is S-shaped.

The underwire can be separated from the internal support by at least 1/16 of an inch, or even by at least 1/8 of an inch, at least 1/3 or an inch, at least 1/4 of an inch or more. The gap between the internal support and the underwire can advantageously provide a space for seams where the internal support material will not interfere.

Additionally or alternatively, the underwire could be attached to the internal support at one or more points, for example via one or more plastic or other rigid or semi-rigid connectors, a generally preferred location for the connectors being the bottom apex region of the underwire curve. For example, a suitable connector can have a width (or horizontal length) of between 0.1-2 inches, more preferably between 0.1-1 inch, and even more preferably a width of between 0.1-0.5 inch. A suitable connector can have a height (or vertical length) that is between 0.1-3/4 of an inch, more preferably between 0.1-1/2 of an inch, and even more preferably a width of between 1/4 and 3/4 of an inch. In some contemplated embodiments, the internal support, connector (s), the underwire, or a combination thereof (e.g., the internal support, connector(s) and the underwire) can be injection molded as a single piece.

The internal support can additionally or alternatively be attached to the underwire along a lower edge of the internal support, for example, such that no connector piece(s) are needed. The lower edge could be attached to an entire length of the underwire, more than 35% of the length of the underwire, more than 50% of the length of the underwire, more than 75% of the length of the underwire, more than 85% of the length of the underwire, or between 50-100% of the length of the underwire. The underwire and the internal support could be attached to one another in any suitable way, for example, via an adhesive, via a chemical bond, or via a stitching.

It is contemplated that an internal support can have a uniform thickness, or could have a thickness that varies along a length, a width, or a combination thereof. For example, when an internal support is cut along the vertical axis at the mid-point of horizontal length 170 (of the internal support) or horizontal length 150 (of the insert), it is contemplated that the thickness at the cross-section could be uniform such that the upper edge, the lower edge and the mid-portion has the same thickness (e.g., when the internal support is cut from a sheet of material having a uniform thickness). As another example, the thickness at the cross-section could be varying, such that the upper edge has a thickness that is different from at least one of a mid-portion and the lower edge. As yet another example, the thickness at the cross-section could be tapered such that the thickness continuously decreases or increases from the upper edge to the lower edge. For example, in FIG. 1D, internal support 120*a* has a uniform thickness along its height. In contrast, internal supports 120*a*-1 and 120*a*-2 have non-uniform thicknesses along their heights. Internal support 120*a*-1 has a thickness that is greatest along the mid-portion, and which tapers off at upper and lower portions. Internal support 120*a*-2 has a thickness that is thicker at a lower curve than at the upper curve, and which similarly tapers off at upper and lower ends.

Additionally or alternatively, the internal support can have a uniform or varying thickness along its horizontal length. For example, when the internal support is cut along the horizontal axis at a mid-point of height 160, it is contemplated that the internal support could show a uniform thickness or a varying thickness along its horizontal length 170. In some aspects, the inner edge of the internal support (closest to the wearer's cleavage when the insert is properly worn) could be thicker, thinner or the same as the outer edge of the internal support (closest to a right or left side of the wearer when the insert is properly worn). In some embodiments, a varying thickness could be gradual and constant from the inner edge to the outer edge (e.g., tapered). In some other embodiments, an internal support with a varying thickness could have a mid-portion that is thicker than each of the inner and outer edges. In yet some other embodiments, an internal support with a varying thickness could have a mid-portion that is thinner than each of the inner and outer edges. In some preferred embodiments, an internal support can comprise a greater thickness at an outer portion than an inner portion (e.g., at least 30% greater, at least 50% greater, at least 75% greater, at least 100% greater, at least 150% greater, at least 200% greater, between 200-400% greater, between 250-350% greater).

Suitable thicknesses for the internal support or portions thereof include, for example, between 0.01-1.0 inch, between 0.01-0.50 inch, between 0.01-0.40 inch, between 0.01-0.30 inch, between 0.01-0.20 inch, between 0.01-0.10 inch, between 0.01-0.08 inch, between 0.01-0.04 inch, or between 0.018-0.040 inch. Where an internal support has a varying thickness, the internal support can include first and second thicknesses, wherein the first thickness is at least 125%, at least 150%, at least 175%, at least 200%, or even at least 250% or more of the second thickness.

Figure 2:
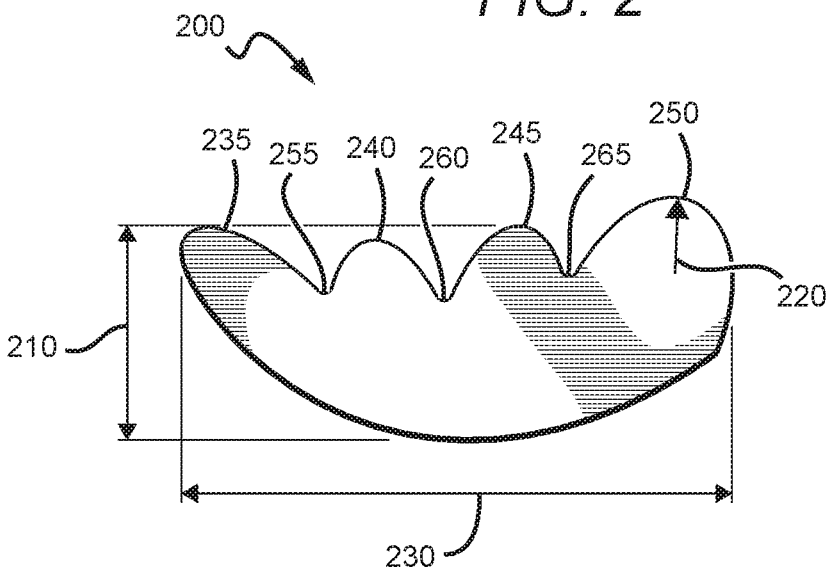
FIG. 2 illustrates an internal support having four peaks.

FIG. 2 illustrates an internal support having four peaks and oriented to have the largest horizontal length possible. Four peaks may be especially suitable for breast supports for smaller breasted women (e.g., A cup, AA cup, B cup), or where enhanced support is desirable in a smaller area of the breast. However, it should be appreciated that internal supports having any number of peaks are contemplated (e.g., 2, 3, 4, 5, 6), as are peaks of various shapes and sizes. It should be appreciated that the number of peaks that are ideal can vary based on other factors, including for example, the width (or horizontal length) and height of the insert, the width and height of the internal support, a width of a peak relative to a width of the internal support, a height of a peak relative to a height of the internal support, or the type of material used (e.g., thickness, hardness, flexibility).

As illustrated, internal support 200 has a length 230, a height 210, and four peaked portions including four peaks 235, 240, 245 and 250, and three valleys 255, 260 and 265. Length 230 is typically not the horizontal length of the internal support 200 when worn, but is the horizontal length of internal support 200 when oriented to have the longest horizontal length possible. Height 210 is measured perpendicularly to length 230, at the point where internal support has the greatest height between the lower edge and the upper edge. The height 220 of a peaked portion can be measured as a straight line extending parallel to height 210 from a bottom-most point of a valley and an upper-post point of a neighboring peak (e.g., valley 265 and peak 250) as a line parallel to height 210. The ratio between height 210 of one, some or all of the peaks, and a height 220 of the internal support 200 can be any suitable ratio, including for example, between 1:1.5 and 1:4, between 1:1.5 and 1:3, between 1:1.5 and 1:2.5, or between 1:2 and 1:2.5. Viewed from a different perspective, the height of one, some or all of the peaks can be at least 10%, at least 20%, at least 25%, less than 50%, less than 40%, less than 30%, less than 25%, less than 20%, between 10-30%, between 10-25% or even between 5-20% of a height 220 of the internal support 200.

Figure 3:
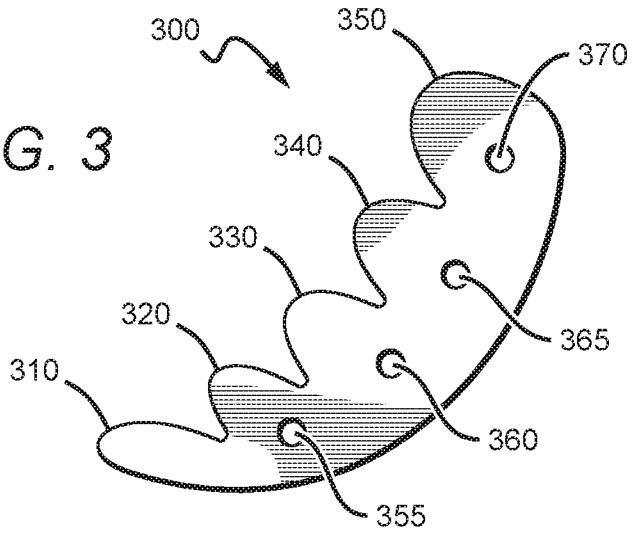
FIG. 3 illustrates an internal support having five peaks.

FIG. 3 illustrates an internal support 300 having five peaks 310, 320, 330, 340, and 350, as it may be oriented when a breast support of the inventive subject matter is worn. Internal support 300 includes a set of perforations 355, 360, 365, and 370.

Preferably, the perforations are each relatively small such that the support provided by internal support is not compromised. Although the perforations can be of different sizes along different portions of the support, some contemplated perforations will have a width of between 0.001-0.80 inch, 0.01-0.80 inch, between 0.01-0.50 inch, between 0.01-0.30 inch, between 0.01-0.20 inch, between 0.01-0.10 inch, or between 0.001-0.010 inch, inclusive. Additionally or alternatively, some preferred perforations will have a height of between 0.001-0.80 inch, 0.01-0.80 inch, between 0.01-0.50 inch, between 0.01-0.30 inch, between 0.01-0.20 inch, between 0.01-0.10 inch, or between 0.001-0.010 inch, inclusive.

In some embodiments, one or more of the perforations can be located beneath an upper-most peak of a peaked portion (e.g., where internal support is oriented as shown in FIG. 2). In FIG. 3, for example, perforation 355 can be positioned beneath peak 320, perforation 360 beneath peak 330, perforation 365 beneath peak 340, and perforation 370 beneath peak 350 such that perforations along shorter portions of the internal support (e.g., beneath a valley, or at an outer-most or inner-most peaked portion) are avoided. Additionally or alternatively, the perforations could be positions about half way between the upper and lower edge (e.g., within 1 cm of the mid-point, or within 5 mm of the mid-point).

Although the perforations are shown as round through-holes, it should be appreciated that perforations all suitable shapes are contemplated, including for example, capsule-shaped, rectangular, triangular, or dome-shaped. Additionally or alternatively, it should be appreciated that an internal support can include any suitable number of perforations, and that the perforations can be identical to one another, or different (e.g., first and second perforations of different sizes or shapes).

Figure 4A:
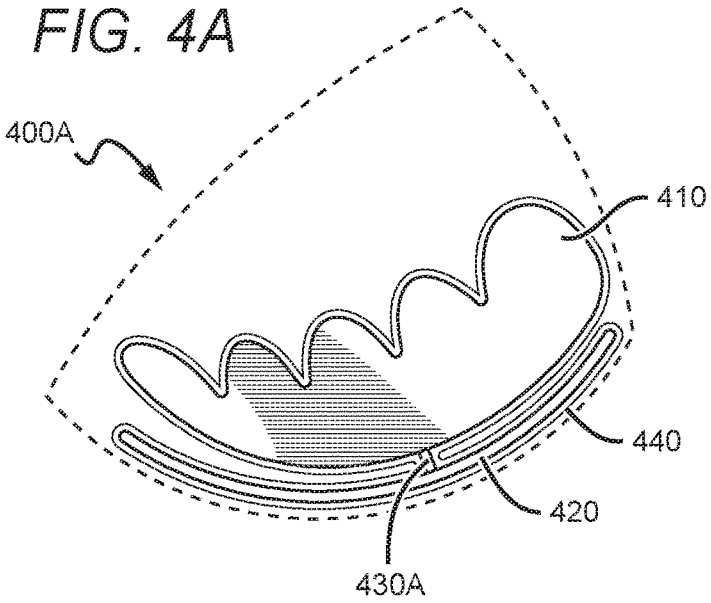
FIG. 4A illustrates a breast support having an internal support attached to an underwire via a connector.
Figure 4B:
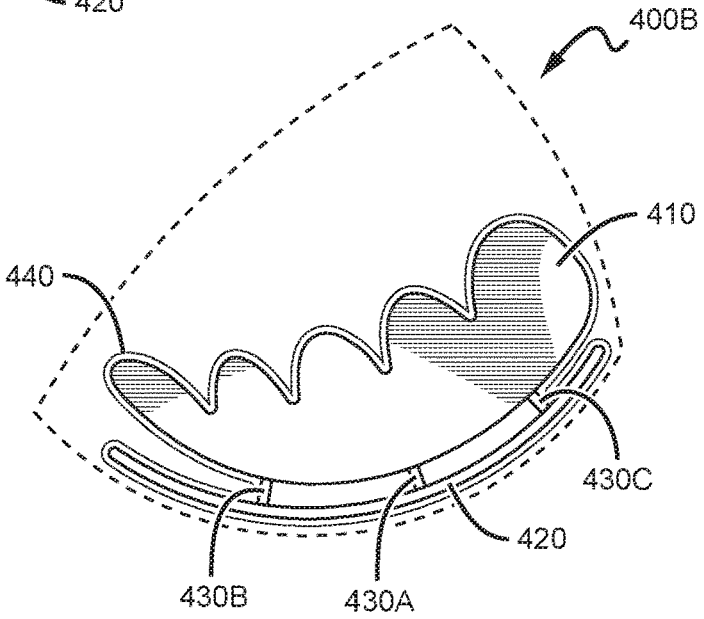
FIG. 4B illustrates a breast support having an internal support attached to an underwire via multiple connectors.

FIGS. 4A-4B illustrate internal components of two alternative embodiments of breast supports 440*a* and 440*b*. Breast supports 440*a* and 440*b* could each comprise an internal support 410 that is coupled to underwire 420 by a connector 430*a*. The internal support 410 is generally separated from underwire 420 by about 1/16-1/4 of an inch, except at the portions where connectors (e.g., 430*a*, 430*b*, 440*c*) are attached.

Contemplated connectors could have any suitable size and shape, but will typically have a length that is less than 25%, more typically less than 15%, less than 10% or less than 5% of a length of an internal support, and a height that is less than 25%, more typically less than 15% or less than 10% of a height of an internal support (when oriented as in FIG. 2).

Each of underwire 420, internal support 410 and the connector (e.g., one or more of 430*a*, 430*b*, 430*c*) can optionally be partially or fully encased/enclosed in an outer material (e.g., fabric) 440, which can optionally be textured, meshed or rubberized. In some alternative embodiments, one or more of the underwire 420, internal support 410 and the connectors 430*a*, 430*b* and 440*c* can themselves be made in part or in whole from a stiff or stiffened piece of material that is textured. Suitable materials for the outer material include, among other things, a textured or rubberized material.

Figure 6:
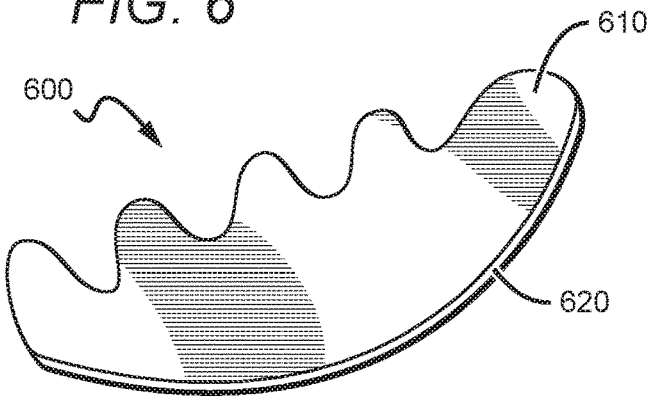
FIG. 6 illustrates an internal support attached to an underwire along a lower edge.

Some contemplated internal supports can include a lower edge that is attached to a substantial length of the underwire, or even an entire length of the underwire. For example, FIG. 6 illustrates an internal support system 600, which includes an internal support 610 having an upper scalloped edge, and a lower edge. The lower edge is attached to an entire length of the underwire 620. In alternative embodiments, the lower edge can be attached to a substantial length of the underwire 620 without being attached to the entire length. For example, the lower edge of the internal support can be attached to between 50-99% of the length of the underwire, between 60-95% of the length of the underwire, or between 70-95% of the length of the underwire.

It is also contemplated that in some embodiments, the internal support and underwire can be made into a single integral piece, comprising the same or different materials, and optionally an injection molded plastic piece.

Figure 5:
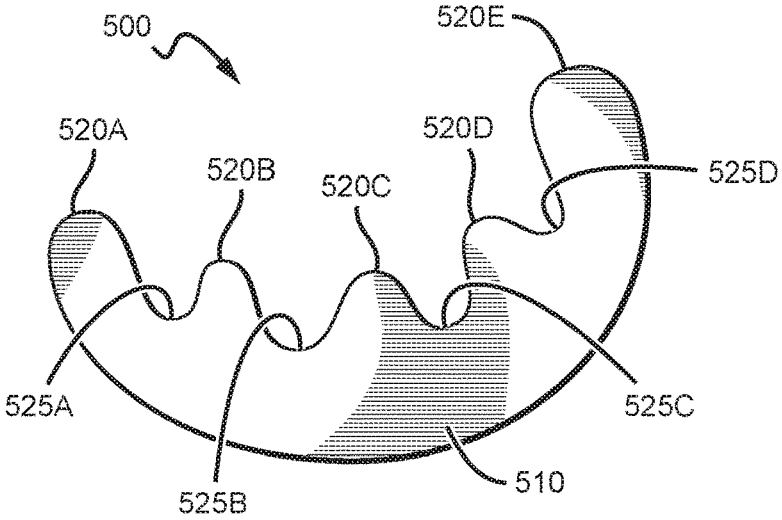
FIG. 5 illustrates another internal support of the inventive subject matter.

FIG. 5 illustrates yet another alternative breast support 500 of the inventive subject matter having an internal support 510 with a substantially U-shape wherein at least one of the inner-most and outer-most peaked portions sized and dimensioned to extend above the wearer's papilla or areola when worn (e.g., extend at least 5 mm, at least 10 mm, at least 15 mm, at least 20 mm above the uppermost portion of the papilla or areola). Internal support 510 comprises five peaks 520*a*, 520*b*, 520*c*, 520*d* and 520*e*, which are separated by valleys 525*a*, 525*b*, 525*c* and 525*d*. In some embodiments, peaks 520*b*, 520*c* and 520*d* could each be positioned on the wearer such that they do not extend over the wearer's papilla or areola, or above the height of the wearer's papilla or areola. In contrast, one or both of peaks 520*a* and 520*e* could be positioned such that they extend above the height of the wearer's papilla or areola, although they may be positioned to the side of the papilla rather than directly over it. Viewed from a different perspective, an internal support can comprise an inner-most peak, an outer-most peak, and a plurality of peaks extending there-between. The height of one or both of the inner-most peak and the outer-most peak can have a height that is greater than a height of each of the plurality of peaks extending there-between (e.g., when oriented as in FIG. 2). It is contemplated that such internal supports could advantageously provide additional structural support to the wearer's breast without causing discomfort to the wearer.

Figure 7A:
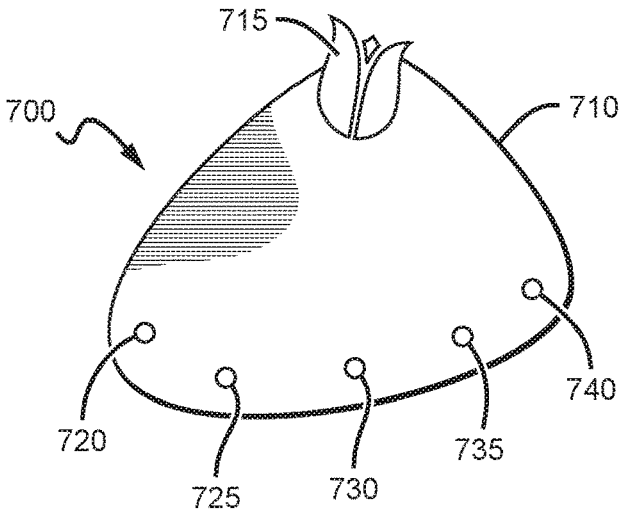
FIGS. 7A-7B illustrate a breast support including gripping material.
Figure 7B:
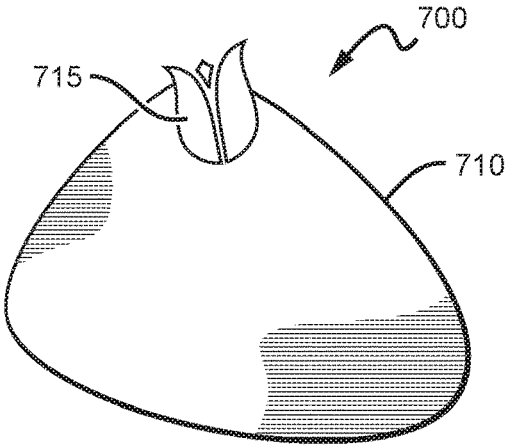

When inserts are placed into pockets of a bra, or even between a bra and the user's breasts, it can be advantageous to include one or more features that help keep the insert in place. FIGS. 7A-7B illustrate front and rear views of a breast support 700 that advantageously includes gripping tabs at various positions to prevent movement when placed in a pocket of a bra or placed against a user's skin.

FIG. 7A is a rear view of breast support 700, which is the side that faces the wearer when the breast support is worn. Cover material 710 can be made of a textured material (e.g., a loosely woven or knitted fabric), which reduces movement of the breast support when pressed against the user's skin or against the inner lining of a bra pocket. Additionally or alternatively, breast support 700 can include gripping tabs 715, 720, 725, 730, 735, and 740, which can be made from any suitable material, preferably one that remains intact through wash and wear. Tab 715 includes a decorative design (here, a logo), and surrounds a portion of cover material 710 such that it is partially positioned on a front side (away from the wearer) of cover material 710, and partially positioned on a rear side of cover material 710. Once breast support 700 is inserted into a pocket of a bra, gripping tab 715 could be positioned in or near the front strap portion of the bra in the pocket, and gripping tabs 720, 725, 730, 735, and 740 could be positioned to contact a lower inner surface of the pocket.

Suitable materials for use in gripping tabs include, among other things, PVC, rubber, silicone, jute, cotton, a combination thereof, or any other suitable material (e.g., a foam or other material coated with rubber or silicone). The gripping tabs can optionally be textured (e.g., comprises a raised bump or tactile pattern) or rubberized for additional grip. Where a gripping tab is coupled to the cover material, it is contemplated that the gripping tab can have a greater adhesion to the wearer's skin or the bra material than an adhesion of the cover material to the wearer's skin or bra material.

Figure 8:
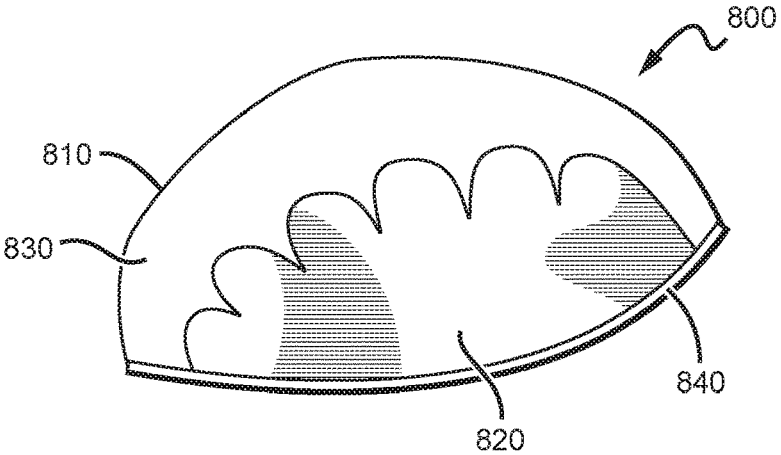
FIG. 8 illustrates internal components of a breast support.

FIG. 8 illustrates internal components of a breast support. Breast support 800 includes a cover material 810 that encloses a plastic internal support member 820 and internal padding 830. Breast support 800 can also include an underwire 840 that is coupled to the cover material, for example, by being partially or fully enclosed in the cover material, or being attached to an outer surface of the cover material.

Internal support member 820 includes a scalloped top edge, which advantageously provides additional flexibility to allow support member 820 to form or mold around breasts of different shapes and sizes when the breast support is worn. Internal support member 820 can be attached to one or more of the cover material 810, the internal padding 830, and underwire 840.

Internal support member 820 could be sized and dimensioned to be positioned over the wearer's papilla or areola when breast support 800 is worn, such that at least some of the scalloped or otherwise peaked portions sit above and curve over the wearer's papilla or areola and towards the wearer.

In some contemplated embodiments, a plurality of internal supports can be provided, each of which could be cut (e.g., laser cut, water jet cut, die cut) from a sheet of material such as polypropylene.

For example, FIG. 9 illustrates breast support 900 including a cup cover 910 that encloses internal padding 930, which at least partially surrounds one or both of internal supports 920 and 925.

In some contemplated embodiments, the bottom edges of each of the padding 930, internal supports 920 and 925, and the cup cover 910 could be sewn or otherwise adhered or fastened together. The underwire 940 could be disposed partially or completely within cup cover 910's bottom edge, or could be sewn or otherwise adhered or fastened to an outer surface of cup cover 910.

Internal supports 920 and 925 could have the same of different shapes, and could have the same of different sizes. Viewed from a different perspective, internal supports 920 and 925 could have the same general shape with an upper scalloped edge, and internal support 920 could have a top to bottom length or a side to side length that is greater, smaller or equal to the top to bottom length or the side to side length of internal support 925. In the example shown, internal support 920 has a larger top to bottom length and a larger side to side length than internal support 925. It is contemplated that some or all of padding 930 could be disposed between internal supports 920 and 925 to create a bump-up effect with additional structural support.

FIG. 10 is a cross-sectional view of another breast support of the inventive subject matter having a push up pad and a c-shaped underwire. Breast support 1000 includes a cup cover 1050 coupled to an underwire 1020 having a C-shaped cross section. Cup cover 1050 houses internal support 1010 and push-up pad 1040, each of which are at least partially surrounded by internal padding 1030. The use of a C-shaped underwire 1020 (or even an underwire having a rod-shaped or half (partial) moon shaped cross-section) can advantageously provide greater comfort to the wearer, and prevent or reduce the appearance of lines forming on the user's skin from the underwire.

FIG. 11 illustrates a breast support system of the inventive subject matter including two breast supports coupled together via a bridge. Although existing bras typically include only two openings near the wearer's underarms for inserting two separate pads/supports, some bras have pockets that are connected to one another via a channel, or include additional openings near the wearer's sternum.

Breast support system 1100 can be used in connection with such bras, and can even be used with bras that do not include any pockets, for example by being placed under the bra. Breast support system 1100 includes first breast support 1110*a* coupled to second breast support 1110*b* via bridge 1120. First breast support 1110*a* includes first internal support 1130*a* and underwire 1140*a*. Second breast support 1110*b* similarly encloses second internal support 1030*b* and is coupled to second underwire 1140*b*.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

Also, as used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements. Moreover, and unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

Thus, specific compositions and methods for breast supporting devices have been disclosed. It should be apparent, however, to those skilled in the art that many more modifications besides those already described are possible without departing from the inventive concepts herein. The inventive subject matter, therefore, is not to be restricted except in the spirit of the disclosure. Moreover, in interpreting the disclosure all terms should be interpreted in the broadest possible manner consistent with the context. In particular the terms "comprises" and "comprising" should be interpreted as referring to the elements, components, or steps in a non-exclusive manner, indicating that the referenced elements, components, or steps can be present, or utilized, or combined with other elements, components, or steps that are not expressly referenced.

What is claimed is:

1. A breast support for a wearer and including a front surface and a rear surface, the breast support comprising:

a cover material;

an internal support and a padding, each of which is at least partially enclosed in the cover material;

wherein the internal support comprises a sheet of material including an upper edge, a lower edge, and a mid-portion that extends between the upper and lower edges;

wherein the internal support has a hardness of at least 50 on the Shore D hardness scale and is positioned at least partially within a thickness of the padding;

wherein the internal support is at least partially encased in a fabric for attaching the internal support to the padding; and wherein the upper edge is a multi-peaked edge having at least one valley portion and at least two peak portions.

2. The breast support of claim 1, further comprising an underwire at least partially enclosed in the cover material, and wherein the internal support is separated from the underwire by at least ⅛ of an inch (0.3175 cm).

3. The breast support of claim 2, further comprising one or more connectors each of which is attached to the internal support and the underwire, thereby attaching the internal support to the underwire.

4. The breast support of claim 1, wherein the fabric surrounding is at least one of textured, meshed and rubberized.

5. The breast support of claim 2, wherein the underwire comprises a C-shaped cross-section.

6. The breast support of claim 1, wherein a length of the internal support is between 60-95% of a length of the breast support.

7. The breast support of claim 1, wherein a height of the internal support is less than 50% of a height of the breast support.

8. The breast support of claim 1, wherein the internal support comprises a set of perforations.

9. The breast support of claim 8, wherein the set of perforations comprises a first perforation and a second perforation, and wherein the first and second perforations are different in size or shape.

10. The breast support of claim 8, wherein each perforation of the set of perforations has a width of between 0.01" (0.0254 cm) to 0.30" (0.762 cm), inclusive or a height of between 0.01" (0.0254 cm) to 0.30" (0.762 cm), inclusive.

11. The breast support of claim 1, wherein the internal support comprises at least four peaks including a first outer peak, a second outer peak, and a set of mid-peaks, and wherein at least one of the first and second outer peaks comprises a height greater than a height of each of the mid-peaks of the set of mid-peaks.

12. The breast support of claim 1, wherein the internal support has a thickness of at least 0.4 mm, and a hardness of between 60-90 on the Shore D hardness scale.

13. The breast support of claim 1, wherein the internal support has a varying thickness including a first thickness and a second thickness, and wherein the first thickness is at least 150% of the second thickness.

14. The breast support of claim 1, wherein at least one of the front and rear surfaces comprises a grippy material that has a greater adhesion to a first material than an adhesion of the cover material to the first material.

15. The breast support of claim 1, wherein the internal support comprises a substantially S-shaped cross-section.

16. The breast support of claim 15, wherein the internal support comprises an upper portion and a lower portion, and wherein the lower portion curves towards the wearer when the breast support is worn.

17. The breast support of claim 1, wherein the internal support comprises a left portion and a right portion, and wherein the left portion has a first cross-sectional shape that is different from a second cross-sectional shape of the right portion.

18. The breast support of claim 17, wherein the first cross-sectional shape is substantially S-shaped, and wherein the second cross-sectional shape is substantially C-shaped.

19. The breast support of claim 17, wherein the first cross-sectional shape has a lower portion that curves towards the wearer.

20. The breast support of claim 19, wherein the second cross-sectional shape has a lower portion that curves away from the wearer.

* * * * *